US005156200A

United States Patent [19]

Mette

[11] Patent Number: 5,156,200

[45] Date of Patent: Oct. 20, 1992

[54] APPARATUS FOR FILLING BOTTLES AND THE LIKE

[75] Inventor: Manfred Mette, Hamburg, Fed. Rep. of Germany

[73] Assignee: alfill Getränketechnik GmbH, Hamburg, Fed. Rep. of Germany

[21] Appl. No.: 562,486

[22] Filed: Aug. 3, 1990

[30] Foreign Application Priority Data

Aug. 11, 1989 [DE] Fed. Rep. of Germany ..... 3926591

[51] Int. Cl.[5] ..... B65B 3/04; B65B 39/12; B67C 3/06

[52] U.S. Cl. ..... 141/46; 141/39; 141/287; 141/302

[58] Field of Search ..... 141/6, 39, 40, 44-51, 141/54, 57-59, 61, 144-147, 151, 152, 181, 182, 177, 263-264, 266, 284, 251, 258, 287, 368, 383, 387, 388, 301, 302, 308; 277/34, 34.3; 285/97

[56] References Cited

U.S. PATENT DOCUMENTS

| | | | |
|---|---|---|---|
| 1,500,620 | 7/1924 | Hoy | 141/368 X |
| 2,513,143 | 6/1950 | Carter | 141/287 X |
| 2,522,884 | 9/1950 | Mann | 141/284 |
| 2,536,746 | 1/1951 | Hollifield | 141/39 |
| 2,695,743 | 11/1954 | Weatherby-Williams | 141/40 X |
| 2,761,607 | 9/1956 | Ayars | 141/147 |
| 2,837,127 | 6/1958 | Luther | 141/147 |
| 2,871,033 | 1/1959 | Stout et al. | 277/34 |
| 2,913,016 | 11/1959 | Luther | 141/147 |
| 3,093,165 | 6/1963 | Risser | 141/147 |
| 3,519,035 | 7/1970 | Remane | 141/287 X |
| 3,683,976 | 8/1972 | Remane | 141/59 |
| 3,695,315 | 10/1972 | Ayars, Jr. | 141/368 |
| 4,349,055 | 9/1982 | Dichiara | 141/39 |
| 4,442,873 | 4/1984 | Yun | 141/39 |
| 4,750,533 | 6/1988 | Yun | 141/46 |
| 4,787,427 | 11/1988 | Bacroix | 141/39 |
| 4,854,353 | 8/1989 | Russell | 141/284 |
| 4,938,261 | 7/1990 | Petri et al. | 141/39 |

FOREIGN PATENT DOCUMENTS

| | | | |
|---|---|---|---|
| 0350974 | 1/1990 | European Pat. Off. | 141/269 |
| 2753336 | 5/1979 | Fed. Rep. of Germany | 277/34 |
| 2132726 | 7/1984 | United Kingdom | 285/97 |

*Primary Examiner*—Henry J. Recla
*Assistant Examiner*—Casey Jacyna
*Attorney, Agent, or Firm*—Peter K. Kontler

[57] ABSTRACT

The filling valve in a counterpressure filling apparatus for admission of liquids into bottles or other types of containers having open upper ends is provided with a sleeve which can descend toward an empty container below the valve and carries a deformable internal annular sealing element which is movable into sealing engagement with the external surface of the open end to center the container. The sealing element is thereupon acted upon by a gaseous fluid to bear against the external surface and to establish a reliable seal during subsequent or simultaneous admission of a pressurized gaseous fluid which precedes the admission of a metered quantity of liquid whereby the liquid expels the gaseous fluid along the same path which serves for admission of pressurized gaseous fluid into the container.

13 Claims, 1 Drawing Sheet

APPARATUS FOR FILLING BOTTLES AND THE LIKE

BACKGROUND OF THE INVENTION

The invention relates to apparatus for filling containers, and more particularly to improvements in apparatus wherein a tubular member surrounds at least the open upper end of a container during introduction of a flowable substance, especially a carbonated beverage. Still more particularly, the invention relates to improvements in apparatus of the type wherein the tubular member surrounds a conduit which serves to convey a gas-containing fluid.

When a container is being filled with a gas-containing fluid, some of the fluid is likely to overflow and to contaminate the surrounding area as well as to prevent introduction of an accurately metered quantity of fluid, such as a carbonated beverage.

U.S. Pat. No. 4,787,427 to Bacroix et al. discloses a container filling apparatus wherein the seal between the liquid-admitting (filling) valve and the container is made directly at the end of the mouth of the container. U.S. Pat. No. 4,750,533 to Yun discloses an apparatus wherein the seal between the valve and the container is made around the inner periphery of the open end of the container. Neither of these proposals is believed to be entirely satisfactory, especially if the interior of the container must be maintained at a very high pressure preparatory to, as well as during, introduction of a liquid (such as a carbonated beverage) into the container.

OBJECTS OF THE INVENTION

An object of the invention is to provide a novel and improved apparatus which can effectively prevent spillage of gas-containing liquids during introduction into bottles or other types of containers.

Another object of the invention is to provide a simple and effective system for preventing overflowing of gases and/or liquids from containers which are in the process of being filled in an automatic filling apparatus.

A further object of the invention is to provide a system which is simple and inexpensive and which can be incorporated in existing apparatus for admission of metered quantities of a liquid medium into bottles or other types of containers.

An additional object of the invention is to provide novel and improved means for establishing a seal with the open fluid-receiving end of a container during admission of a metered quantity of a beverage or another liquid.

SUMMARY OF THE INVENTION

The invention is embodied in an apparatus for filling bottles and like containers of the type having an upper end (e.g., the mouth of the neck of a bottle) provided with a fluid-admitting inlet. The apparatus comprises a tubular member (hereinafter called sleeve for short) having an open lower end and serving to receive at least the upper end of a container which is to be filled, a fluid conveying conduit having a discharge end within the sleeve, and an annular sealing element provided in the sleeve (preferably in the lower end of the sleeve) and serving to establish a seal around the container (preferably around the upper end of the container) when the upper end extends into the sleeve.

The apparatus further comprises means for effecting a movement of the sleeve and the container beneath it relative to each other, for example, a cam and follower arrangement which can move the sleeve up and down away from and around at least the upper end of a container below the sleeve.

The sealing element can be made of an elastomeric material or is merely flexible. In either event, the sealing element is deformable so that it can be deformed by a fluid-operated means which serves to bias the deformable sealing element against the external surface of the container when the upper end of the container extends into the sleeve. The fluid-operated means can include a source of pressurized gaseous fluid, and such source can include or can be constituted by the aforementioned conduit. The latter can include a length of rigid tube which is installed within the sleeve.

The apparatus further comprises means for supplying metered quantities of a liquid (e.g., a carbonated beverage) into the container while the upper end of such container extends into the sleeve and is already engaged by the sealing element. Such apparatus can further comprise means for admitting a gaseous fluid into the container by way of the conduit prior to admission of liquid into the container. The conduit preferably serves to establish a path for the escape of gaseous fluid from the container while the container receives a metered quantity of liquid. The liquid supplying means can include a tube which is received in the sleeve and surrounds the conduit. The tube has an internal annular seat and the apparatus further comprises means for moving the conduit and the tube relative to each other (e.g., for moving the conduit relative to the tube) so that the conduit moves against and away from the seat to thus interrupt and establish a path for the flow of liquid into the container which is properly engaged by the sealing element.

The apparatus can further comprise means for reducing the bias of the fluid-operated means upon the sealing element, and such bias reducing means can comprise a pneumatic valve.

The sealing element can have a substantially U-shaped cross-sectional outline and can be recessed into the internal surface of the open lower end of the sleeve. Alternatively, the sealing element can comprise or constitute a hollow ring.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figures 1, 2:
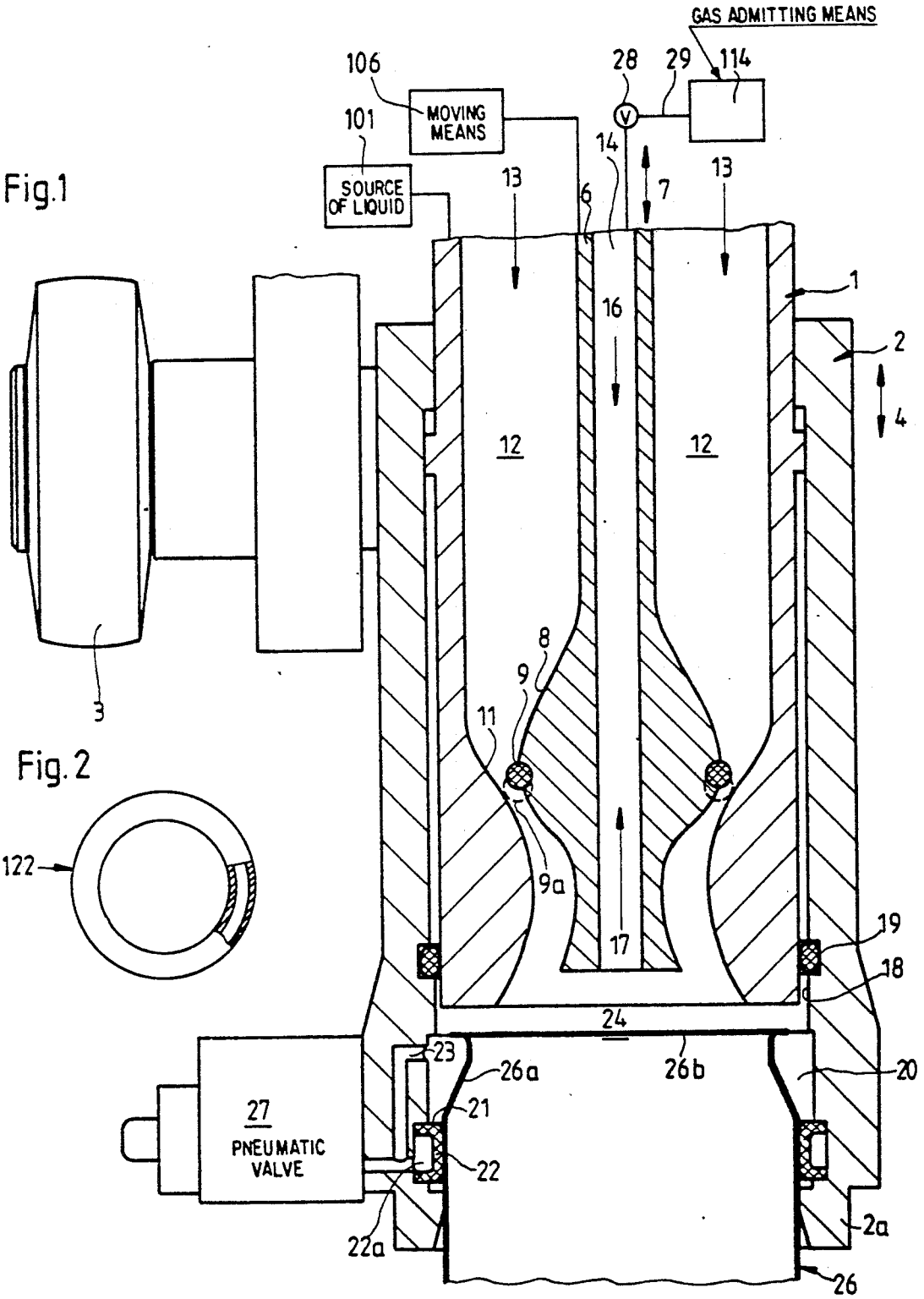
FIG. 1 is a fragmentary schematic partly elevational and partly vertical sectional view of a portion of an apparatus which embodies one form of the invention and wherein a container is in the process of receiving a metered quantity of liquid.
FIG. 2 is a partly elevational and partly sectional view of a modified sealing element which can be used in the apparatus of FIG. 1.

FIG. 1 shows a portion of an apparatus which includes an upright cylindrical tube 1 which need not move up and down and serves as a means for supplying metered quantities of a liquid (e.g., a carbonated beverage) into successive containers 26. The tube 1 is surrounded by a sleeve-like member 2 (also known as tulip and hereinafter called sleeve for short). The sleeve 2 is movable up and down so that its open lower end 2a respectively surrounds and is lifted above the open upper end or mouth 26a of a container 26 beneath the tube 1. The means for moving the sleeve 2 up and down (arrow 4) comprises a roller follower 3 which tracks a suitable cam (not shown). The apparatus preferably comprises an annulus of tubes 1 and sleeves 2, and such tubes and sleeves are caused to orbit along an endless path adjacent a cam which lifts successive sleeves 2 during one or more first stages of each orbit and causes or permits successive sleeves to descend during one or more second stages of each orbit. Reference may be had to commonly owned copending patent application Ser. No. 07/542,719 filed Jun. 22, 1990 by Walusiak, now U.S. Pat. No. 5,063,978 granted Nov. 12, 1991, which discloses an apparatus with several filling units. Each such unit can comprise a tube 1 and a sleeve 2.

The tube 1 has an internal annular seat 11 which can be engaged by the valving element 8 of a vertically movable fluid conveying conduit 6 in the form of a rigid tube. The valving element 8 has an external circumferential groove for a sealing ring 9 which can engage the seat 11 when it descends to the broken-line position 9a of FIG. 1. The means for moving the conduit 6 up and down (arrow 7) to thereby move the ring 9 into and from sealing engagement with the seat 11 is shown at 106. Such moving means can comprise a cam and follower arrangement, a cylinder and piston assembly or the like.

The conduit 6 serves to admit into the container 26 a pressurized gaseous fluid, e.g., carbon dioxide, nitrogen, air or another suitable gas. Such pressurized gas is admitted prior to admission of a metered quantity of a liquid (e.g., a beverage) by way of the tube 1. The conduit 6 further serves to establish a path for expulsion of gases from the interior of the container 26 during admission of liquid via tube 1.

The tube 1 can receive a liquid medium (note the arrows 13) from a source of supply 101, and such liquid is normally pressurized by a gaseous fluid such as $CO_2$ gas. The liquid medium which enters the tube 1 gathers in an annular chamber 12 which surrounds the conduit 6 and is sealed from below when the sealing ring 9 engages the seat 11. The gas flows through an axial passage 14 of the conduit 6 in the direction of arrow 16 on its way into and in the direction of arrow 17 out of the container 26 beneath the tube 1.

The sleeve 2 has a groove which is provided in its internal surface 18 and receives an O-ring 19 or an analogous sealing element which engages the external surface of the tube 1 to prevent leakage of gases from the space 24 within the open lower end 2a of the sleeve and upwardly between the upper portion of the sleeve and the adjacent portion of the tube 1. In addition, the internal surface 18 is provided with a second ring-shaped groove 21 for an annular sealing element 22 which has a U-shaped cross-sectional outline and surrounds the upper end 26a of the container 26 when the sleeve 2 is maintained in the lower end position of FIG. 1. The upper end 26a of a properly introduced container 26 extends upwardly beyond the sealing element 22, namely into an annular space 20 which communicates with the space 24 and with the open lower end of the conduit 6.

The sealing element 22 is made of a flexible material, e.g., an elastomeric plastic material, and its web bears against the external surface of the upper end 26a while the conduit 6 admits a gaseous fluid as well as while the tube 1 admits a liquid. This sealing element can be biased against the external surface of the upper end 26a by a pneumatically operated unit including a portion of the sleeve 2 and a source of pressurized gaseous fluid, preferably the conduit 6. To this end, the lower part of the sleeve 2 has a channel 23 which communicates with the lower end of the conduit 6 by way of the space 24 and can admit pressurized gaseous fluid into an annular compartment 22a behind the sealing element 22. The reference character 27 denotes a pneumatic valve which can be actuated to reduce the pressure in the compartment 22a.

The illustrated sealing element 22 can be replaced with a sealing element 122 of the type shown in FIG. 2. The sealing element 122 is a hollow ring. If the sealing element 22 is replaced with the ring 122, pressurized fluid which is admitted into the compartment 22a bears against the exterior the ring 122 and biases a portion of the ring 122 against the external surface of the upper end 26a of a container beneath the tube 1. This ensures that the gaseous fluid and/or the liquid medium cannot escape by flowing downwardly from the space 24 and along the external surface of the upper end 26a. The reference character 26b denotes the fluid-admitting inlet of the container 26 beneath the sleeve 2.

The ring 122 can be designed to be inflated by pressurized fluid in order to sealingly engage the external surface of a container which extends into the sleeve 2.

The mode of operation of the apparatus which is shown in FIG. 1 is as follows:

The sleeve 2 and the conduit 6 are maintained in raised positions (not shown) during advancement of an empty container 26 to a position of alignment with the tube 1, i.e., beneath the lower end 2a of the sleeve 2. When the container 26 is properly positioned relative to the tube 1, the moving means including the roller follower 3 lowers the sleeve 2 to the position which is shown in FIG. 1. This causes the sealing element 22 to engage the external surface at the upper end 26a and to center the container 26 relative to the sleeve 2. The conduit 6 descends simultaneously with or in synchronism with the sleeve 2 so that the sealing ring 9 is moved from the solid-line position to the broken-line position 9a and engages the seat 11 to seal the annular chamber 12 of the tube 1 from the interior of the container 26, i.e., from the space 24 and from the lower end of the passage 14 in the conduit 6.

The admission of pressurized gas-containing liquid from the chamber 12 into the interior of the container 26 is preceded by opening of a valve 28 which is installed in the conduit 29 between the gas admitting means 114 and the upper end of the passage 14 so that the conduit 6 receives and conveys a stream of pressurized gas (such as $CO_2$ gas) which enters the container 26 as well as the channel 23 and compartment 22a to bias the web of the sealing element 22 against the external surface of the upper end 26a of the container. Upon completion of pressure equalization, the conduit 6 is lifted relative to the sleeve 2 so that the sealing ring 9 rises from the broken-line position 9*a* and permits a metered quantity of liquid to descend from the chamber 12 into the interior of the container 26 while the sealing element 22 continues to bear against the external surface of upper end 26*a*. The inflowing liquid expels the previously admitted gas which escapes from the container 26 via passage 14 in the direction of arrow 17. Such flow of gas can be evacuated via valve 28.

When the admission of a metered quantity of liquid from the chamber 12 into the container 26 is to be terminated, the conduit 6 is again lowered so that the sealing ring 9 reassumes the position 9*a* to thus terminate the flow of liquid from the chamber 12 into the container. The next step involves opening of the valve 27 to reduce the pressure in the compartment 22*a* behind the sealing element 22 so that the bias of the sealing element 22 upon the external surface of the upper end 26*a* of the freshly filled container 26 is reduced or terminated. This renders it possible to lift the sleeve 2 and the conduit 6 with a minimum of effort so that the sleeve assumes its upper end position in which the filled container 26 can be moved away from alignment with the tube 1 and a fresh (empty) container can be caused to assume a required position for reception of a metered quantity of liquid from the chamber 12. The filling operation is then repeated in the aforedescribed sequence.

The improved apparatus can be modified in a number of ways without departing from the spirit of the invention. For example, the sealing element 22 can be replaced with a sealing element other than that which is shown in FIG. 2.

An important advantage of the improved apparatus is that the sealing element 22 or its equivalent reliably prevents escape of gaseous and/or hydraulic fluid during pressurizing of the container 26 prior to admission of liquid as well as during and following admission of liquid from the chamber 12. The sealing action is reliable even if the gas which is admitted via passage 14 of the conduit 6 and/or the liquid which is admitted from the chamber 12 is maintained at a very high pressure.

Another important advantage of the improved apparatus is that, if the apparatus is a so-called counterpressure filling apparatus (as actually shown and described), gaseous fluid which is employed to bias the sealing element 22 or 122 against the external surface of a container to be filled can be supplied by the same part (conduit 6) which serves to supply pressurized gas into the container prior to admission of a selected quantity of liquid. Thus, it is not necessary to provide a separate source of pressurized fluid for the sole purpose of biasing the sealing element 22 or 122.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for filling bottles and like containers of the type including an upper end having a first outer diameter and provided with a fluid-admitting inlet and a larger-diameter portion adjacent said upper end and having an external surface, comprising a sleeve having an open lower end arranged to admit a container; a fluid conveying conduit which discharges fluid into said container, said conduit having a discharge end within said sleeve; means for moving said sleeve up and down away from and around a container below said sleeve; a deformable annular sealing element provided in said sleeve and designed to establish a seal around the external surface of the larger-diameter portion when a container extends into said sleeve; and fluid-operated means for biasing said deformable sealing element against the external surface of the larger-diameter portion of a container which extends into said sleeve.

2. The apparatus of claim 1, wherein said sealing element is elastic.

3. The apparatus of claim 1, wherein said sealing element is flexible.

4. The apparatus of claim 1, wherein said fluid-operated means includes a source a pressurized gaseous fluid.

5. The apparatus of claim 4, wherein said source is said conduit.

6. The apparatus of claim 1, wherein said conduit is a tube within said sleeve.

7. The apparatus of claim 1, further comprising means for supplying a metered quantity of a liquid into the container which extends into said sleeve and is engaged by the biased sealing element.

8. The apparatus of claim 7, further comprising means for admitting by way of said conduit a gaseous fluid into the container which extends into said sleeve prior to admission of liquid into such container, said conduit being arranged to establish a path for the escape of gaseous fluid from the container which extends into said sleeve while the container receives a metered quantity of liquid.

9. The apparatus of claim 7, wherein said supplying means comprises a tube which is received in said sleeve and surrounds said conduit, said tube having a seat and further comprising means for moving said conduit against and away from said seat to thus interrupt and establish a path for the flow of liquid into the container which extends into said sleeve.

10. The apparatus of claim 1, further comprising means for reducing the bias of said fluid-operated means upon said sealing element.

11. The apparatus of claim 10, wherein said bias reducing means comprises a pneumatic valve.

12. The apparatus of claim 1, wherein said sealing element has a substantially U-shaped cross-sectional outline.

13. The apparatus of claim 1, wherein said sealing element is a hollow ring.

* * * * *